US008115401B2

(12) United States Patent
Nguyen

(10) Patent No.: US 8,115,401 B2
(45) Date of Patent: Feb. 14, 2012

(54) SAFETY STARTER DEVICE

(75) Inventor: Thanh Tam Nguyen, Hulst (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 534 days.

(21) Appl. No.: 12/300,852

(22) PCT Filed: May 8, 2007

(86) PCT No.: PCT/IB2007/051714

§ 371 (c)(1),
(2), (4) Date: Nov. 14, 2008

(87) PCT Pub. No.: WO2007/132402

PCT Pub. Date: Nov. 22, 2007

(65) Prior Publication Data

US 2009/0184647 A1 Jul. 23, 2009

(30) Foreign Application Priority Data

May 15, 2006 (EP) ..... 06113908

(51) Int. Cl.
*H05B 39/02* (2006.01)
*H05B 41/00* (2006.01)

(52) U.S. Cl. ..... 315/209 M; 315/209 T

(58) Field of Classification Search ..... 315/209 T, 315/209 CD, 209 M, 209 SC, 112, 114–118, 315/94, 100, 105
See application file for complete search history.

(56) References Cited

U.S. PATENT DOCUMENTS

| | | | | | |
|---|---|---|---|---|---|
| 3,098,137 | A * | 7/1963 | Cook | 337/27 |
| 3,699,385 | A * | 10/1972 | Paget | 315/239 |
| 4,344,018 | A * | 8/1982 | Inada | 315/47 |
| 4,742,275 | A * | 5/1988 | Ito et al. | 315/104 |
| 6,194,846 | B1 * | 2/2001 | Van Veldhuizen | 315/309 |
| 2003/0085668 | A1 | 5/2003 | Van Veldhuizen | |

FOREIGN PATENT DOCUMENTS

| | | | |
|---|---|---|---|
| BE | 501085 | A | 4/1952 |
| BE | 502171 | A | 7/1952 |
| DE | 1223055 | B | 8/1966 |
| FR | 928543 | A | 12/1947 |
| FR | 950825 | A | 10/1949 |
| FR | 62423 | E | 6/1955 |
| FR | 2100135 | A | 3/1972 |
| GB | 2254970 | A | 10/1992 |
| JP | 01246791 | A | 10/1989 |
| JP | 2001023492 | A | 1/2001 |

* cited by examiner

*Primary Examiner* — Douglas W Owens
*Assistant Examiner* — Minh D A

(57) ABSTRACT

A safety starter circuit for a gas discharge lamp includes a series arrangement of a glow switch starter, a resistive element, and a thermally controlled switching element. The thermally controlled switching element is in a heat transfer relationship with the resistive element so that the thermally controlled switching element is effectively heated by heat generated in the resistive element. The thermally controlled switching element is designed to make a transition from a conductive state to a non-conductive state when its temperature exceeds a predetermined cut-off temperature. The thermally controlled switching element is arranged in a gas-tight casing.

2 Claims, 1 Drawing Sheet

SAFETY STARTER DEVICE

This application is a national stage application under 35 U.S.C. §371 of International Application No. PCT/IB2007/051714 filed on May 8, 2007, which claims priority to European Application No. EP06113908.5 filed on May 15, 2006.

FIELD OF THE INVENTION

The present invention relates in general to a starter device for igniting a gas discharge lamp. In particular, the invention relates to a safety glow switch starter for a fluorescent lamp.

BACKGROUND OF THE INVENTION

Discharge lamps need to be ignited by applying a voltage higher than a threshold voltage, indicated as breakthrough voltage. For sustaining the discharge, a lower voltage suffices. The level of the breakthrough voltage depends on certain conditions, such as the temperature of the lamp electrodes: at higher temperature, the breakthrough voltage is lower. For generating an ignition voltage pulse, it is known to arrange a ballast comprising an inductor in series with the lamp and to arrange a switch in parallel with the lamp. In a first step, the switch is closed (i.e. conductive), so that a current flows through the inductor and the lamp electrodes to heat the electrodes and to charge the inductor. In a second step, the switch is opened (i.e. made non-conductive), so that the inductor generates a high-voltage pulse over the lamp electrodes. This high-voltage pulse causes a discharge in the lamp, which is accompanied by a visible light flash. If the conductivity in the discharge channel is sufficient, the discharge can be sustained by the mains voltage. In practice, it may take a few of these switching cycles before the lamp ignites.

A conventional example of such starter switch is a glow switch. A glow switch basically consists of bimetal contacts which in normal conditions are opened. If a voltage is applied, a small glow current flows through the switch, the glow discharge heating the contacts so that they close. In the closed condition, the switch carries a larger current to heat the lamp electrodes, but the bimetal switch contacts cool down so that after a few seconds they open again.

At the end of the operational lifetime of the lamp, ignition becomes more difficult, briefly speaking because the electrodes are exhausted. If no precautionary measures are taken, a normal glow switch starter will keep on switching, resulting in repeated discharge flashes in the lamp, which is visible as a flickering of the lamp. This flickering is experienced by people as irritating. Additionally, as a result of the continuous application of large currents, the starter, the lamp tube and the ballast may become hot, which is potentially dangerous.

This problem is already recognized in the art, and several solutions for solving this problem have already been proposed.

US-2003/0.085.668 discloses the use of a semiconductor switch in combination with a solid state timer which limits the time during which the switch attempts to start the lamp.

GB 2.254.970 discloses a starter device for a fluorescent lamp, comprising a glow igniter, a resettable bimetallic switch, and an NTC resistor connected in series to one another, and further comprising an ohmic resistor arranged in parallel with the NTC resistor. The current through the glow igniter causes heat development in the resistors. This heat is transferred to the bimetallic switch. Normally, the lamp ignites after a few switching cycles, and the starter circuit remains without current as from the moment of ignition so the heat generation is stopped. Normally, the heat developed till this moment is not sufficient to actuate the bimetallic switch. In the event of the lamp failing to ignite, the continued heat generated in the resistors causes the temperature of the bimetallic switch to rise sufficiently so that it opens, thereby interrupting the electrode heating circuit. In this case, the bimetallic switch is of a type which does not close automatically on cooling down: the switch needs to be reset manually by a user. Thus, as long as the user does not reset, the irritating flickering of the lamp is stopped.

The device of GB 2.254.970 has several disadvantages. An important disadvantage is that this device poses a safety risk particularly in an oil, gas or chemical industry environment. When the switch opens, the current is interrupted the hard way by contacts that go apart, and a flashover may occur, which is particularly unsafe in situations with flammable gases. Further, it may happen that the bimetallic switch is blocked, i.e. it does not open; in that case, the ignition process will continue, so that parts of the lamp assembly may get heated, which also may cause unsafe situations.

An object of the present invention is to provide a starter for a gas discharge lamp, which is inherently safe in its operation.

SUMMARY OF THE INVENTION

To that end, the present invention proposes to have at least the switching element arranged in a gas-tight housing. Even if a flashover occurs when the switch opens, the gas-tight housing prevents flammable gases from reaching the switch's contacts and thus prevents possible gasses from being ignited by such flashover. Preferably, the switching element is implemented as a thermal fuse; a significant advantage of a thermal fuse is that it does not provide mechanically switching, so the risk of flashover is reduced.

In principle, the heating resistors may be arranged outside the gas-tight housing. However, it is preferred that also the heating resistor(s) is/are arranged inside the gas-tight housing, as close to the switching element as possible.

In a preferred embodiment, the thermal fuse component is a thermal fuse resistor, consisting of a thermal fuse in series with a resistor, which are in good thermal contact with each other. A thermal fuse resistor in series with the switching component provides a simple, yet effective way of protecting the starter circuit from overheating.

It is noted that thermal fuse resistors are known per se. For instance, a thermal fuse resistor is disclosed in JP 2001-023492.

BRIEF DESCRIPTION OF THE DRAWINGS

These and other aspects, features and advantages of the present invention will be further explained by the following description with reference to the attached drawings, in which same reference numerals indicate same or similar parts, and in which.

DETAILED DESCRIPTION OF THE INVENTION

Figure 1:
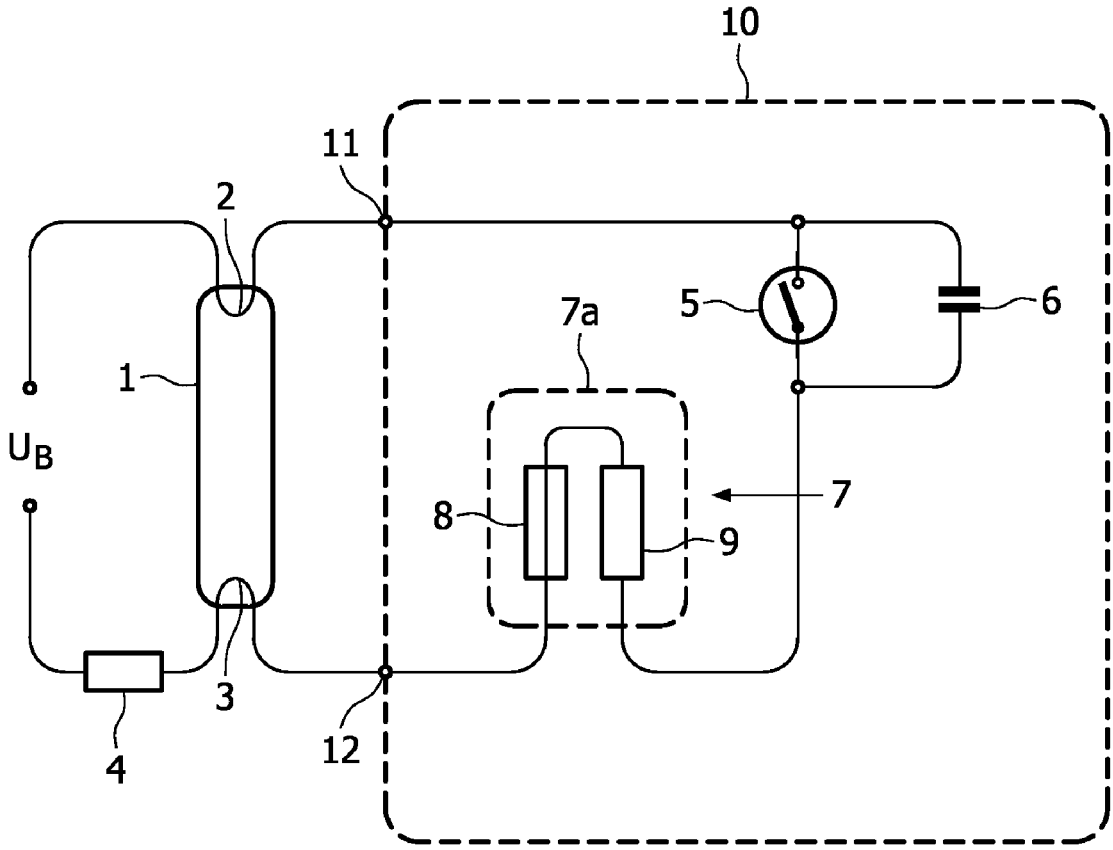
FIG. 1 shows an electrical circuit diagram of a fluorescent lamp with a safety starter circuit according to the invention.

FIG. 1 shows an electrical circuit diagram of a fluorescent lamp 1 connected to a safety starter device 10 according to the invention. The fluorescent lamp 1 comprises two electrodes 2 and 3, and can be supplied with a voltage $U_B$ via a ballast 4 which serves to limit the current through the lamp after ignition. Each electrode has two electrode terminals. First electrode terminals of the electrodes 2, 3 are connected to supply $U_B$. Second electrode terminals of the electrodes 2, 3 are connected to the connection terminals 11, 12 of the safety starter circuit 10.

The safety starter circuit 10 comprises a bi-metallic glow switch 5 and a thermal fuse resistor 7, which are connected in series with each other between the connection terminals 11, 12. The thermal fuse resistor 7 comprises a thermal fuse 8 connected in series with a resistor 9. The fuse 8 and the resistor 9 are in good thermal contact with each other, sealed in one common casing 7*a*. A capacitor 6 is arranged in parallel with the glow switch 5. Alternatively, the capacitor may be arranged in parallel with both the glow switch and the thermal fuse resistor.

The operation of the fluorescent lamp 1 with the safety starter circuit according to the invention is as follows.

When the lamp 1 is off and a voltage UB is applied across connecting leads of the circuit, a small current of a few mA will flow through the electrodes 2, 3, the glow switch 5, the resistor 9 and the thermal fuse 8. In the glow switch 5, a glow discharge will heat the bi-metal contacts until they close. In the closed situation, the current will increase to a value in the order of e.g. 0.5 to 1.5 A, depending on lamp type and other components, and this current will heat up the electrodes 2, 3 in the lamp 1. The bi-metal contacts of the switch cool down, and the switch opens again. The ballast 4 generates a high voltage pulse over the lamp electrodes 2, 3. Usually, the contacts of the glow switch 5 reopen and close a few times before the lamp 1 ignites. After lamp ignition, the glow switch contacts will remain open and no current will flow through the starter circuit 10 anymore.

In case the lamp 1 does not ignite, e.g. due to end-of-life of the lamp, the glow switch 5 continues to close and open for a longer period of time. During this period, the continuously flowing current causes heat to be generated in the resistor 9, which in turn causes the temperature of the thermal fuse resistor 7 to increase. When the temperature reaches a so-called cut-off temperature, the thermal fuse 8 melts and this softly interrupts the starter circuit permanently. A flashover is unlikely to occur. Even if a flashover would occur, the current interruption occurs in an inheritantly safe manner because such flashover would occur within the casing 7*a*, effectively shielded from possible flammable gases.

It is also possible that components of the starter device 10 fail. In case the glow switch 5 fails in that the contacts of the glow switch stick together, the high current will continuously flow through the starter circuit. Again, this current will cause the temperature of the thermal fuse resistor 7 to increase so that eventually the thermal fuse 8 melts, thus interrupting the circuit permanently. In case the capacitor 6 fails and causes a short circuit, the same applies.

Thus, both in the case of a lamp failure and in the case of a starter failure, the starter circuit is switched off permanently and no further lamp flicker or high currents will occur. Since a starter circuit according to the invention cannot be reset, it leads to an inherent safety, which is especially appreciated in environments where oil and/or gas are processed, or where chemicals are used.

It may be desirable that the thermal fuse 8 melts after predetermined period of time, for instance 5 minutes. However, the heat dissipated in the resistor 9 depends on the current during the heating phase of the lamp electrodes, which in turn depends on lamp type. It is noted that thermal fuse resistors exist in a wide range of resistor values and a wide range of cut-off temperatures. A skilled person will understand how a thermal fuse resistor should be selected to match the properties of a specific discharge light system so that a specific switch-off time is achieved. In practical circumstances, the thermal fuse resistor will typically have a resistance in the range of approximately 2.2 Ω to approximately 47 Ω.

It should be clear to a person skilled in the art that the present invention is not limited to the exemplary embodiments discussed above, but that several variations and modifications are possible within the protective scope of the invention as defined in the appending claims.

It is noted that the casing 7*a* may be implemented as a hollow housing with an inner space, or as a massive block of for instance plastics.

The invention claimed is:

1. A safety starter device for a gas discharge lamp (1), comprising a series arrangement of:

a glow switch starter comprising bi-metal contacts configured to close the glow switch starter when heated for igniting the gas discharge lamp, the glow switch starter being further configured to open and remain open after ignition of the glow switch starter;

at least one resistive element;

a thermally controlled switching element comprising a thermal fuse;

wherein the thermally controlled switching element is in a heat transfer relationship with the resistive element so that the thermally controlled switching element is effectively heated by heat generated in the resistive element;

wherein the thermally controlled switching element is designed to melt and make a permanent transition from a conductive state to a non-conductive state when its temperature exceeds a predetermined cut-off temperature; and wherein at least the thermally controlled switching element is arranged in a gas-tight casing; and wherein the resistive element is arranged in the gas-tight casing.

2. The safety starter device according to claim 1, wherein the combination of thermally controlled switching element and resistive element is implemented as a thermal fuse resistor.

* * * * *